US005418523A

United States Patent [19]

Anderson et al.

[11] Patent Number: 5,418,523

[45] Date of Patent: May 23, 1995

[54] EARTHQUAKE MOTION DETECTOR ALARM

[76] Inventors: James M. Anderson; William M. Anderson, both of 545 E. 14th St., Apt. 2-B, New York, N.Y. 10009

[21] Appl. No.: 215,151

[22] Filed: Mar. 21, 1994

[51] Int. Cl.[6] ..... G08B 21/00

[52] U.S. Cl. ..... 340/690; 200/61.45 R; 200/61.51; 340/669

[58] Field of Search ..... 340/690, 669, 540; 200/61.49, 61.5, 61.51, 61.45 R

[56] References Cited

U.S. PATENT DOCUMENTS 3,359,550 12/1967 Christensen ..... 200/61.51

4,297,690 10/1981 Baker ..... 340/690

4,432,041 2/1984 Pfisterer et al. ..... 340/540

4,789,922 12/1988 Cheshire ..... 340/690

4,797,661 1/1989 Wiley ..... 340/669

*Primary Examiner*—Glen Swann

*Attorney, Agent, or Firm*—Morgan & Finnegan

[57] ABSTRACT

The Earthquake Motion Detector Alarm consists of a pendulum hanging within a sensor ring. At the instant of earth movement, the pendulum weight will make contact with the sensor ring setting off an audio alarm and floodlamp. The magnetized sensor ring can be adjusted so the detector can be installed to function on all vertical walls by positioning the pendulum weight within the ring.

1 Claim, 4 Drawing Sheets

EARTHQUAKE MOTION DETECTOR ALARM

BACKGROUND OF THE INVENTION

This invention relates to an earthquake alarm system for detecting tremors indicative of an earthquake, and generating an audible alarm and emergency lighting in response to such tremors.

This invention makes available to the public a life-saving motion detector alarm. The alarm would alert a person residing in his/her home or other type of building that tremors caused by earth movement (earthquake) have just occurred. The possibility exists there may be life-threatening structural damage. The alarm gives people time, from a few seconds to several minutes, to seek immediate cover or vacate the structure. The detector consisting in part of an audio alarm and emergency floodlamp would be particularly beneficial to persons who are sleeping when an earthquake happens. The audio alarm would awaken them. The floodlamp would supply light so they could see to choose the escape route that may save their lives.

SUMMARY OF THE INVENTION

The detector consists of a pendulum enclosed in a plastic case. The unit is to be attached securely to a vertical wall in a residence or public building. Whenever there is earth movement causing the building to sway even a minimal degree, the pendulum weight, which is encircled by an electrical sensor ring, makes contact with one of three sensors on an outer ring surrounding the pendulum weight. This action completes a circuit triggering a relay switch and timer. The relay switch energizes another circuit which activates the audio alarm and emergency floodlamp. The timer may be set to operate for three minutes before shutting off the alarm and floodlamp.

BRIEF DESCRIPTION OF DRAWINGS

The invention will be described in greater detail below by way of reference to the following drawings, wherein.

DETAILED DESCRIPTION OF THE PREFERRED EMBODIMENT

Figure 1:
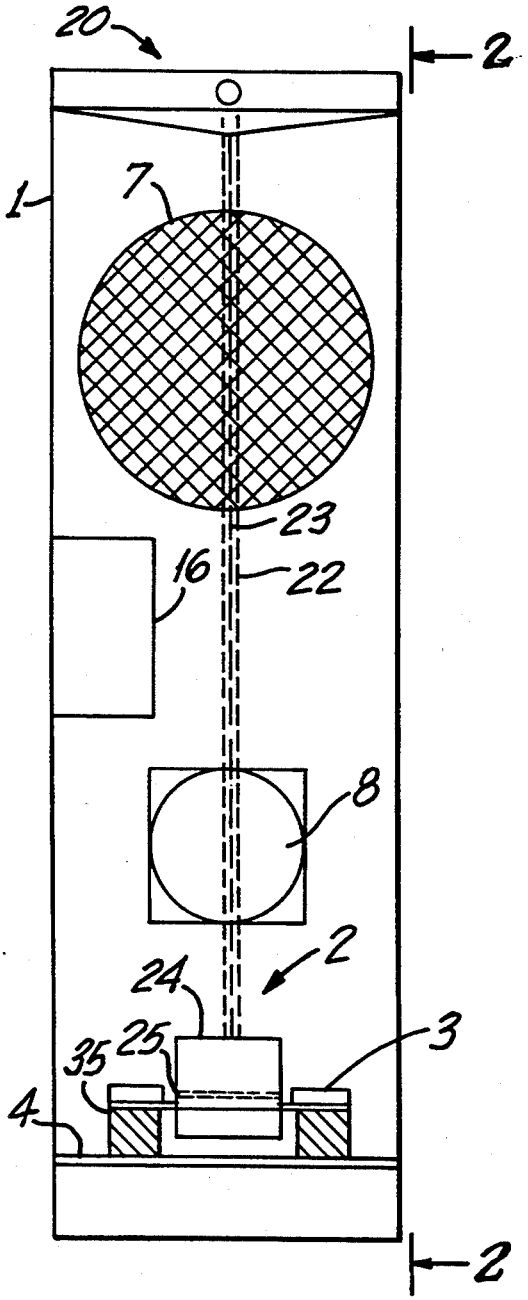
FIG. 1 is a front view of an earthquake motion detector alarm of the invention.
Figure 2:
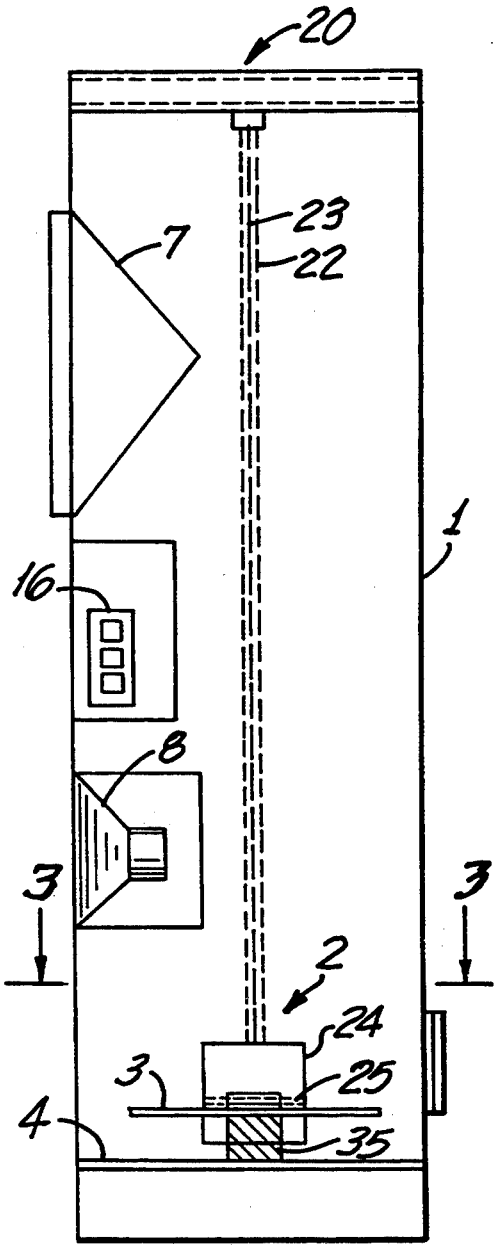
FIG. 2 is a side view of the earthquake motion detector alarm when viewed along line 2—2 of FIG. 1.
Figure 5:
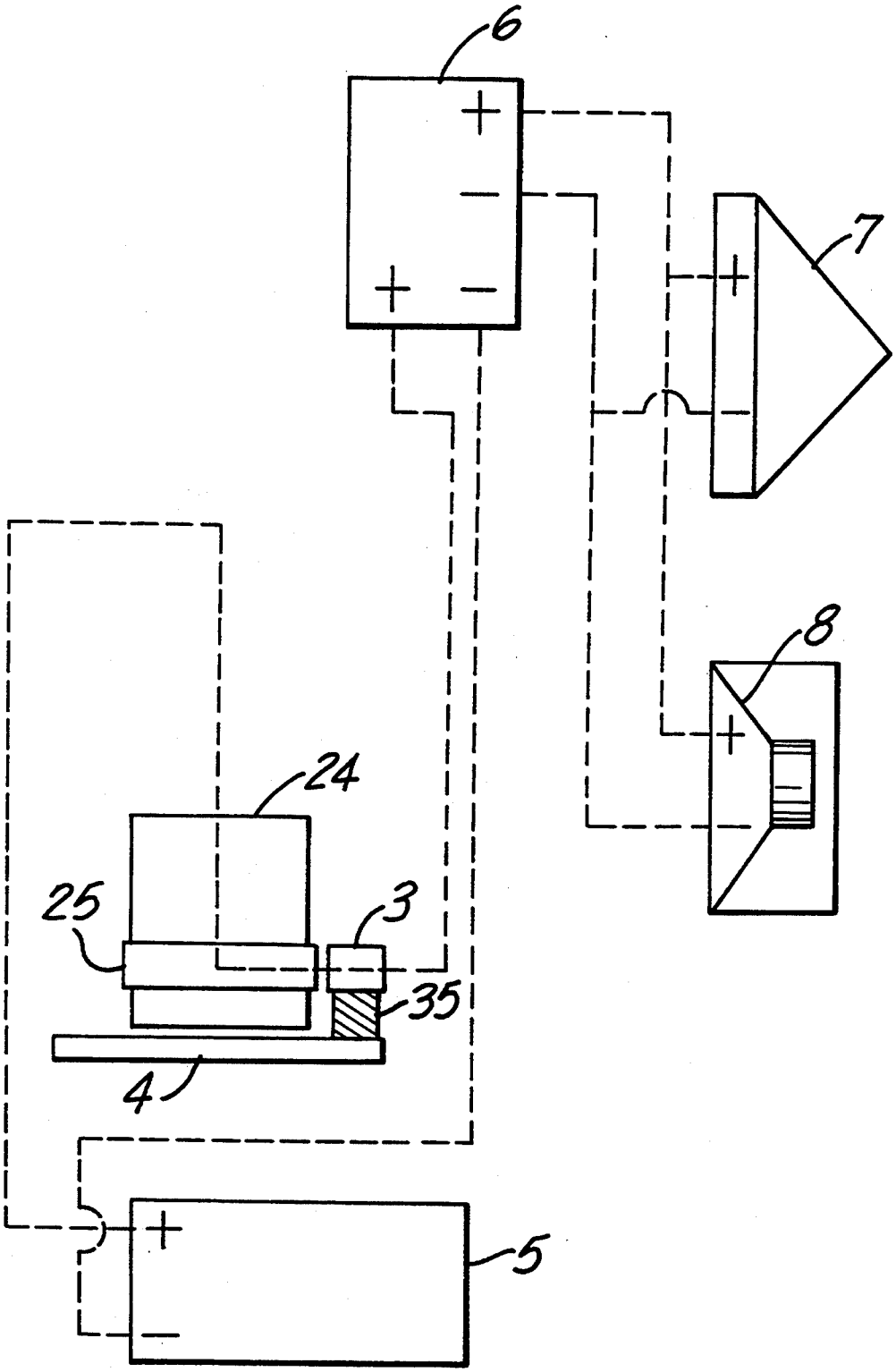
FIG. 5 is a schematic diagram illustrating the electrical circuitry for the earthquake motion detector alarm.

Referring to FIGS. 1, 2, and 5 earthquake motion detector alarm 20 comprises a case 1, a pendulum assembly 2, an outer sensor ring 3, a base plate 4, an energizing means 5, a relay timer switch 6, a floodlamp 7, and an audio-alarm 8.

The case 1 contains the components comprising the earthquake motion detector alarm 20. The case 1 is preferably formed from molded plastic with dimensions of approximately $3\frac{1}{2}'' \times 3\frac{1}{2}'' \times 12''$. The rear surface of the case 1, which is to be attached flush to a vertical wall, allows access for assembly and/or repairs of the detector.

The floodlamp 7 is disposed in the front surface of the case 1. The floodlamp 7 consists of a halogen light bulb, preferably nine-volts; a reflector; a lens designed to defuse the light. The front surface of the case 1 has a series of slots so that the audio alarm 8 can be clearly heard. A sliding panel in the lower front surface of the case 1 allows access to the interior of case 1 to facilitate the installation or replacement of the energizing means 5, which is preferably a nine volt battery, and/or the adjustment of the outer sensor ring 3. One side of the Case 1 allows for installation of an on-off-test switch 16.

The pendulum assembly 2 consists of a metal shielded cable 22 enclosing an insulated electrical wire 23 and a molded plastic pendulum weight 24, which is cylindrical in shape and preferably one inch in diameter and one inch high. The weight 24 is encircled by an electric sensor wire 25 connected to the wire 23 enclosed in the shielded cable 22. One end of the cable 22 would be attached to the top of the Case 1 and the other end to the pendulum weight 24.

Figure 3:
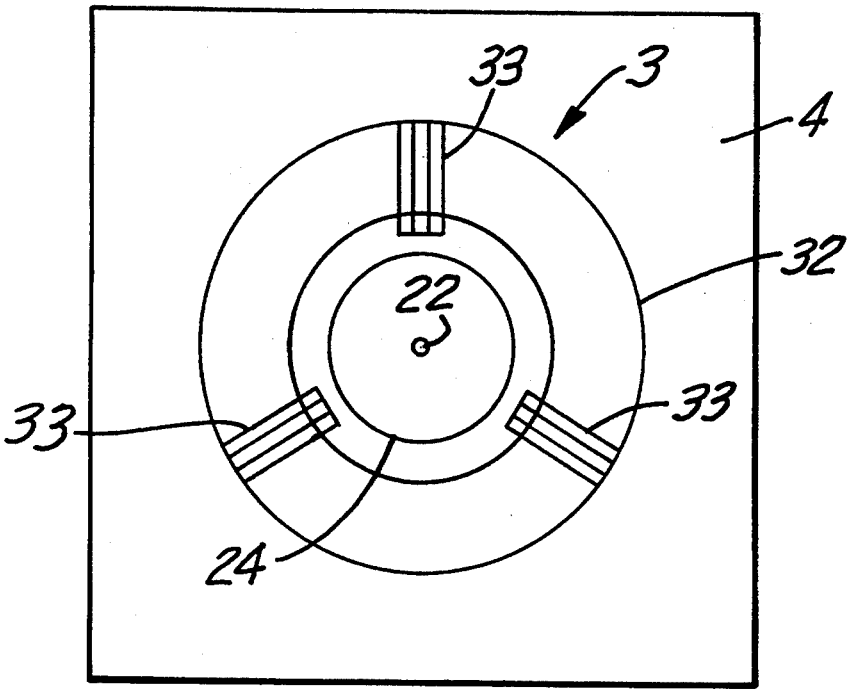
FIG. 3 is a cross-sectional view of the earthquake motion detector alarm when viewed along line 3—3 of FIG. 2.

Referring to FIG. 3, the outer sensor ring 3 surrounds the pendulum assembly 2, preferably with a 3/16" space between the two rings. The outer sensor ring 3 consists of a molded plastic ring 32 and secured to the top-side part of the ring would be three electrical sensors 33, each spaced 120 degrees apart. Preferably, the inner dimension of the ring 32 is $1\frac{3}{8}''$ in diameter. Each sensor protrudes 1/16" into the inner space between the two rings. This would allow $\frac{1}{8}''$ clearance between the pendulum assembly 2 and the contact sensors 33. Attached directly below each contact sensor 33 on the bottom side of the ring 32 is a magnet 35, preferably a $\frac{1}{2}''$ cube. Each sensor 33 is joined to a single wire connected to the relay timer switch 6. The outer sensor ring 3 is mounted on the metal base plate 4.

The metal base plate 4 is a metal plate which a magnet is attracted, preferably with dimensions of $3\frac{1}{2}'' \times 3\frac{1}{2}'' \times 1/16''$. The plate 4 serves as the base for the outer sensor ring 3. The magnetized ring 3 can be moved to any position on the metal plate while encircling the pendulum weight 24.

The electrical circuitry for the earthquake motion detector alarm 20 is shown in schematic form in FIG. 5. The energizing means 5, which preferably is a nine-volt battery, is disposed in the bottom portion of the Case 1. A "positive" wire is connected from the battery through the pendulum assembly 2 to the pendulum sensor Ring. Another "positive" wire is connected between the outer sensor ring 3 contacts and the "positive" terminal of the relay switch 6. A "negative" wire is connected between the "negative" battery terminal and the "negative" terminal of the relay switch 6. The relay switch 6 is wired with "positive" and "negative" terminals that are connected by wires to the floodlamp 7 and the audio alarm 8.

The relay timer switch 6 activates when the circuit is completed at the instant the electric sensor wire 25 encircling the pendulum weight 24 contacts the outer sensor ring 3. A built-in timer would energize the relay switch 6 for a period of time, preferably on the order of three minutes, that would activate the floodlamp 7 and the audio alarm 8. Preferably, the on-off-test switch 16 is an integral part of the relay timer switch 6.

The audio alarm 8 emits a high-pitched sound that could be heard by a person at least 40 feet away from the detector.

Figure 4:
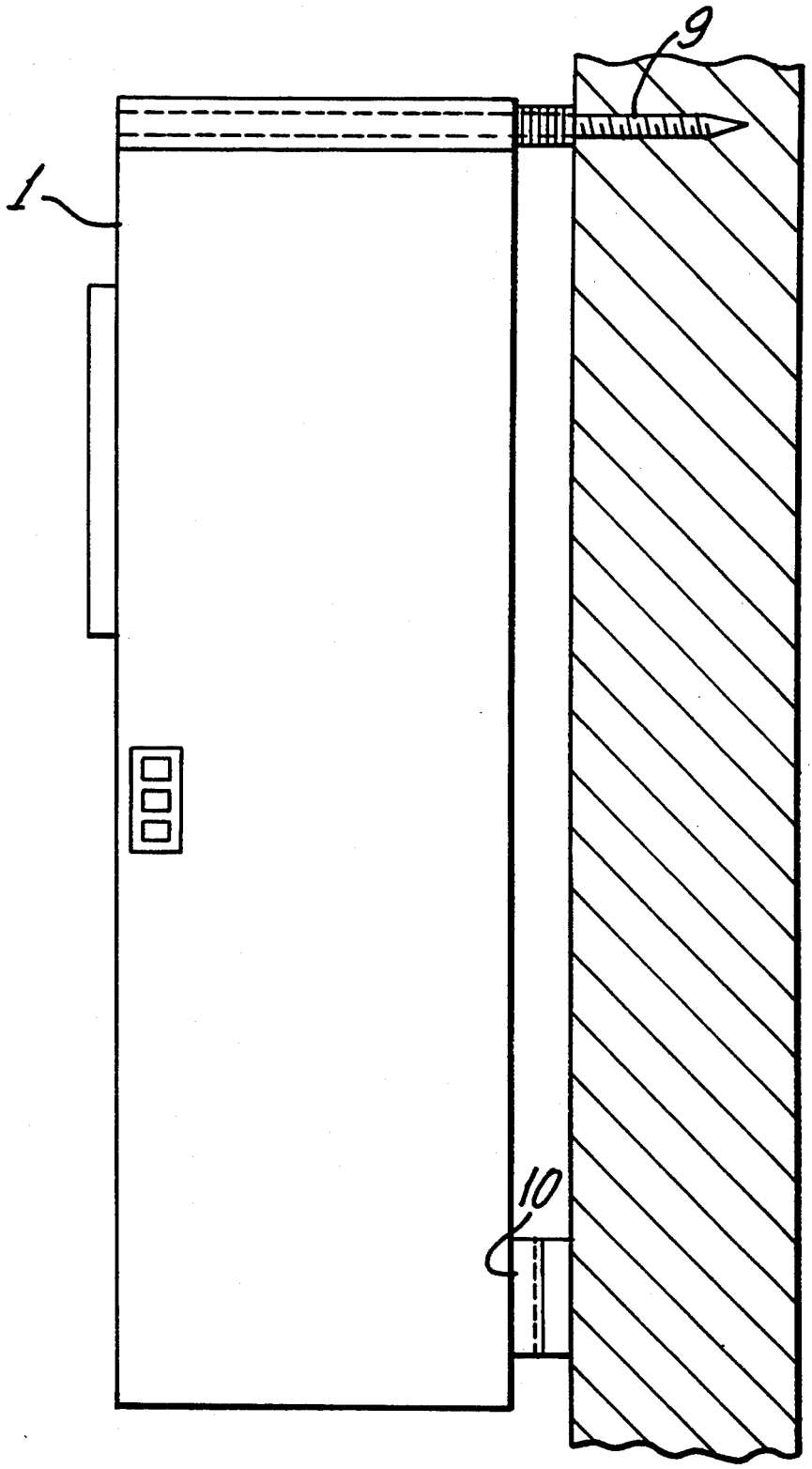
FIG. 4 is a side view of the earthquake motion detector alarm attached to a vertical wall.

The detector must be installed precisely otherwise it will not function. Referring to FIG. 4, the earthquake motion detector alarm 20 can be affixed to a vertical wall by an anchor screw 9 through a hole near the top of the case 1. Velcro strips 10 are to be attached to the rear side at the bottom of the case 1 and to the vertical wall at a location where the two strips can be joined together. A plastic washer is inserted between the detector and the wall of the same width as the thickness of the velcro strips 10 securing the bottom of the case 1 to the wall. The anchor screw 9 should be secured preferably into a vertical wood stud or solid masonry wall. The plastic spacer of the same width as the velcro strips must be inserted between the detector and the vertical wall.

After screwing the case 1 to the wall, it should be allowed to position itself perfectly vertical so the pendulum will "hang" straight up and down. After this is accomplished, the two velcro strips 10 should be securely pressed together between the bottom of the case 1 and the vertical wall. The case 1 must be securely anchored both top and bottom to the wall. The pendulum weight 24 should be hanging equidistant within the outer sensor ring with a ⅛" space all around between the outer sensor rings and the electric sensor wire 25 encircling the pendulum weight 24.

In the event the pendulum weight 24 does not hang freely within the outer sensor ring 3, it can be adjusted or "fine tuned" through visual observation by manually moving the magnetized outer sensor ring 3 to the desired position on the metal base plate 4. The outer sensor ring 3 should be positioned so there is an equidistant space between the pendulum weight 24 and the outer sensor rings. The magnets 35 should be of sufficient strength that they will ensure that the outer sensor ring 3 will remain securely in place once the outer sensor ring 3 is properly positioned.

We claim:

1. An earthquake motion detector alarm adapted to be contained in a compact case which is to be affixed to a vertical wall, comprising:

a supporting wire having one end attached to the top surface of the case;

a pendulum weight attached to the other end of the supporting wire;

an electrical sensor ring surrounding the pendulum weight, the electrical sensor ring having three sensors surrounding the pendulum weight such that there is a gap between each sensor and the pendulum weight, the gap sized so that during an earthquake the pendulum weight will change position and contact the sensors;

an audio alarm;

an emergency light;

an energizing means;

an electrical circuitry connecting the energizing means, the pendulum weight, the electrical sensor ring, the audio-alarm, and the emergency light so that the audio-alarm and emergency light will be energized when the pendulum weight contacts the sensors in response to an earthquake;

a metal base plate secured in position relative to the bottom of the case; and a plurality of magnets affixed to the electrical sensor ring, the magnets removably attaching the electrical sensor ring to the metal base plate so that the positioning of the electrical sensor ring relative to the pendulum weight can be readily adjusted to maintain an equidistant gap between each sensor and the pendulum weight.

* * * * *